United States Patent [19]

Lehman

[11] 4,132,030

[45] Jan. 2, 1979

[54] FLYING SAUCER TOY WITH SELECTIVELY POSITIONABLE FINGER GRIP SUPPORT LEGS

[76] Inventor: James A. Lehman, 314 Wisconsin Ave., El Cajon, Calif. 92020

[21] Appl. No.: 820,429

[22] Filed: Aug. 1, 1977

[51] Int. Cl.[2] ..... A63H 27/00

[52] U.S. Cl. ..... 46/74 D; 273/106 B

[58] Field of Search ..... 46/74 D, 75, 220; 273/106 B, 105.4; 272/107

[56] References Cited

U.S. PATENT DOCUMENTS

| | | | |
|---|---|---|---|
| 305,117 | 9/1884 | Teipel | 273/105.4 |
| 1,683,643 | 9/1928 | Wittmaak | 273/106 B |
| 3,700,172 | 10/1972 | Gallegos, Sr. | 46/74 D X |

FOREIGN PATENT DOCUMENTS

| | | | |
|---|---|---|---|
| 467331 | 1951 | Italy | 46/74 D |
| 439985 | 1935 | United Kingdom | 273/106 B |

*Primary Examiner*—Louis G. Mancene
*Assistant Examiner*—Mickey Yu
*Attorney, Agent, or Firm*—Frank D. Gilliam

[57] ABSTRACT

The invention pertains to a hand tossed flying saucer toy having at least one combination selectively positionable peripheral finger grip/leg to provide greater control and enable the user to impact a greater spin to the toy and to support the saucer while at rest on a flat surface for ease of picking up for use.

8 Claims, 6 Drawing Figures

FLYING SAUCER TOY WITH SELECTIVELY POSITIONABLE FINGER GRIP SUPPORT LEGS

BACKGROUND OF THE INVENTION

Flying saucer toys have become increasingly popular during the past years. A typical saucer is circular with a depending peripheral flange or lip and aside from some slight changes form an accurate cross-section, and the possible addition of a few annular ridges on top, has not changed appreciably in common usage since its inception.

Although the entertainment value of tossing these saucers is undeniable, there are certain deficiencies in the toy as presently designed which it is attempted to remedy by the invention disclosed herein. Because the toy has a circular continuous edge, no provision is made for a secure grip for the user's hand and thus the accuracy and degree of spin imparted to the toy is less than ideal. Also, the speed with which the unit is thrown may be somewhat limited by the necessity of disengaging the fingers from beneath the lip as it is released as a firm engagement of these fingers is an absolute necessity to impart an ideal spin to the toy. These toys, because of their normal construction from lubricious materials are nearly impossible to grab hold of for use, especially when resting on a flat surface or where the outer surface is wet.

SUMMARY OF THE INVENTION

The instant invention provides the above deficiencies by providing at least one positionable finger grip/leg combination. These are generally positioned about the edge of the saucer toy. These finger grip/legs provide gripping surface for imparting a spin to the toy as well as providing support legs for ease of gripping the toy when at rest. Although the finger grip/leg may take many different forms, it is shown in the various figures as a substantially rectangular member resting on the outer surface or rim of the toy. The finger grip/leg may be removably secured to the toy by various means. One example of attachment means is a plurality of apertures positioned around the rim. The finger grip/legs have a thread opening that abuts one of the plurality of apertures. A threaded screw is passed from the inside of the rim of the toy and secured within the threaded opening in the finger grip/leg. The finger grip/legs may be added to an existing saucer toy by means of a clamp which secures to the lip of the toy holding the finger grip/leg in place.

These grip/legs may extend below the lip of the toy any distance sufficient to lift the saucer toy from a flush position with its resting surface. The finger grip/legs can be positioned equally spaced about the rim to equally distribute the weight or can be positioned in any other location to effect the flight of the toy. The weight of the finger grip/legs can be of various different or equal weight to effect the saucer flight pattern and speed.

DETAILED DESCRIPTION OF THE PREFERRED EMBODIMENT

Figure 1:
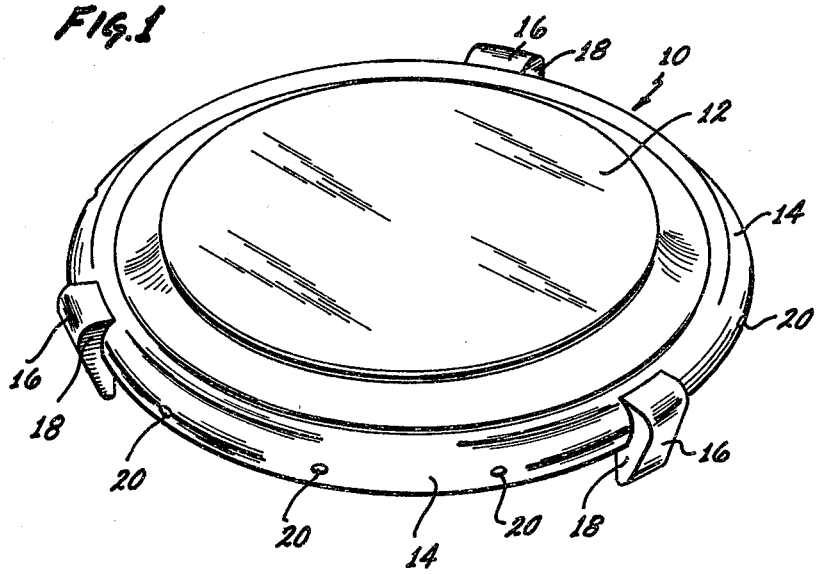
FIG. 1 is an elevated perspective view of a saucer toy having equally spaced apart finger grip/legs secured to the rim through apertures in the saucer.
Figure 2:
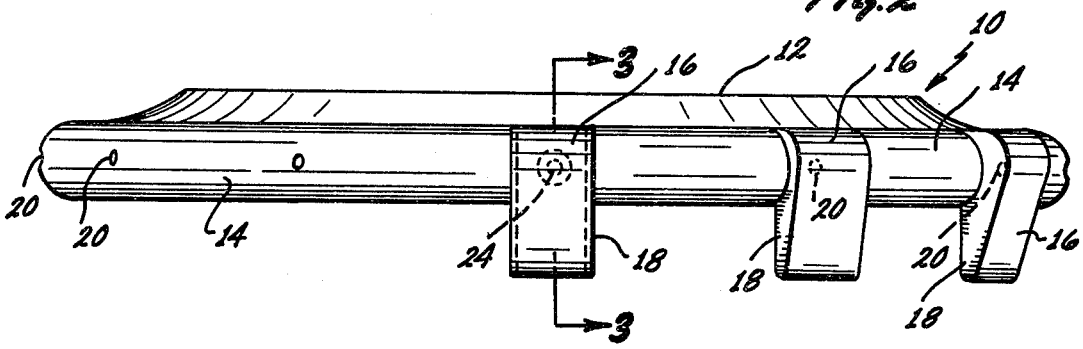
FIG. 2 is an end view of the saucer of FIG. 1 with these finger grip/legs grouped together.

A flying saucer toy 10 is shown in FIG. 1 which is typical of the existing toy saucers, having a central body portion 12 with a depending lip 14. In the embodiment of FIGS. 1 and 2, there are three finger grip/legs 16 attached to the depending lip 14 so that edges 18 can be gripped by the finger of the user. Any one of the finger grip/legs can be utilized by the user. The edge 18 could of course be shaped somewhat differently provided that there is an edge on either side that may be gripped by the index finger of the user either right or left handed.

The saucer 10 of FIGS. 1 and 2, is shown with a plurality of spaced apart apertures 20 positioned around the lip 14 of the saucer.

Figure 3:
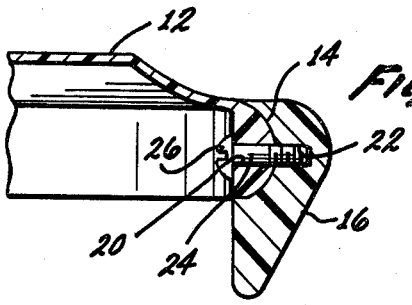
FIG. 3 is a showing of FIG. 2 taken along lines 3—3.

Referring now to FIG. 3, the saucer aperture 20 is aligned with a threaded aperture 22 positioned on the concave side of the finger grip/leg. A screw 24 or the like having an enlarged head 26 of greater cross-section than the aperture 20 is passed through aperture 20 and threaded into the finger grip/leg 16. The screw 24 is tightened until the finger grip/leg 16 is secured firmly to the saucer rim 14. The finger grip/legs 16 can of course be removed by reversing the attachment procedure.

Figure 4A:
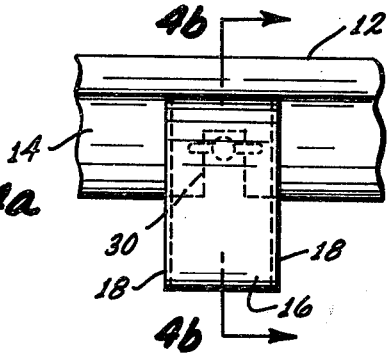
FIG. 4*a* is a front view of a finger grip/leg attached by clamp means to the saucer rim.
Figure 4B:
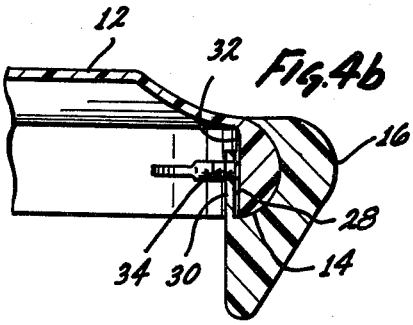
FIG. 4*b* is a showing of FIG. 4*a* taken along lines 4*b*—4*b*.
Figure 4C:
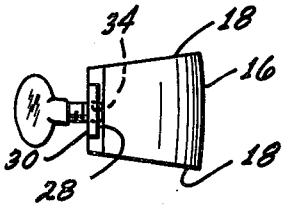
FIG. 4*c* is a plan view of the finger grip/leg of FIG. 4*a*.

The finger grip/leg shown in FIG. 4 does not require that the saucer toy 10 have apertures through its rim, such as, with existing saucers. The finger grip/leg shown in FIG. 4*a*–*c* rear a cavity 28 that substantially conforms to the inner and outer surface of the lip of saucer 10. The rlear surface 30 of the finger grip/leg rests against the inner surface 32 of the lip. The rear surface 30 includes a threaded aperture 34. A wing nut screw or the like is threaded into the aperture 34 until it abuts the inner surface 32 of the lip 14. The screw now holds the finger grip/leg 16 in place.

Although the finger grip/legs 26 are shown with generally concave inner surfaces mating with the convex outer saucer lip surface it should be understood that due to the construction material of conventional saucer toys, being deformable, they need not need to exactly conform to the saucer surface to practice the invention. The construction material normally allow the joined components to have sufficient distortion when the attachment screw is tightened to substantially conform one to the other. If, of course, the materials of construction were rigid then a closer conforming configuration will be required or a sponge rubber padding may be inserted between the elements.

The finger grip/legs 26 must extend a distance below the lower surface of the rim 14 to enable the average user of the toy to insert his fingers between the lower surface of the rim 14 and the supporting surface (not shown). This feature allows a saucer toy constructed of lubricious material, such as plastics, especially when wet to be easily picked up from a supporting surface.

The gripping edge 18 in either embodiment may be provided at various angles (see FIG. 4*c*) including a straight edge (see the various other FIGURES); it has been found that an angle of approximately 30° with the radius of the saucer works quite well.

Although the invention is quite simple in description, its effect on the play in saucer tossing is quite significant. One advantage of the finger gripping/leg is that a much higher degree of spin can be imparted to the saucer, because rather than having to twist the entire hand and wrist to impart the spin, the user's index finger is wrapped around one finger gripping/leg and can easily throw the saucer in a side arm fashion. The extended finger grip/leg allows the user the ability to throw the saucer in new and unique ways depending on the positioning and shape of the finger grip/legs 26.

When the finger grip/legs 26 are formed from a heavy material, such as, but not limited to lead great speeds can be imparted to the saucer toy as well as long distances of flight.

It should be understood that although the finger grip/legs have been shown throughout this description as being removably attached finger grip/legs may be molded into the rim of the device as an integral part thereof to practice the invention. The plurality of finger grip/legs could be molded in the various positions as shown for the removable finger grip/legs. The finger grip/legs may be molded to the device for performing flight contests between a number of participants where the devices need to be of a uniform configuration.

Many changes may be made in details of the instant invention, in the method and material of fabrication, in the configuration and assemblage of the constituent elements, without departing from the spirit and scope of the appended claims, which changes are intended to be embraced therewithin.

Having thus described the invention, what is claimed as new and useful and desired to be secured by United States Letters Patent is:

1. A hand tossed flying saucer toy comprising:

a saucer-like body with a peripheral depending lip;

a plurality of protruding finger grips removably attached to the exterior surface of said depending lip, said finger grips are selectively positionable as desired for effecting the flight characteristics of said flying saucer toy; and attachment means for removably attaching said finger grips to said exterior surface of said depending lip in their selected positions.

2. The invention as defined in claim 1, wherein said finger grips protrude downward and outward from said exterior surface of said depending lip.

3. The invention as defined in claim 1, wherein said attachment means comprises a plurality of spaced apart apertures of a quantity greater than the quantity of said finger grips positioned around said depending lip and attachment members for passing through an aperture from the inner surface of said depending lip and engaging one of said finger grips.

4. The invention as defined in claim 3, wherein said attachment member threadedly engages said one of said finger grips.

5. The invention as defined in claim 1, wherein said attachment means is a clamp member which grips the inner surface of said depending lip.

6. The invention as defined in claim 1, wherein said exterior surface of said depending lip and the depending lip mating surface of each of said plurality finger grips substantially conform when mated.

7. The invention as defined in claim 1, wherein the finger engaging surfaces of each of said finger grips are substantially parallel.

8. The invention as defined in claim 1, wherein the finger engaging surfaces of each of said finger grips define an angle on the order of 30 with the radius of said saucer passing along said finger engaging surfaces.

* * * * *